US009160098B1

(12) United States Patent
Liao et al.

(10) Patent No.: US 9,160,098 B1
(45) Date of Patent: Oct. 13, 2015

(54) ELECTRICAL CONNECTOR

(71) Applicant: Cheng Uei Precision Industry Co., Ltd., New Taipei (TW)

(72) Inventors: Ten Fan Liao, New Taipei (TW); Ming Chun Lai, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/311,240

(22) Filed: Jun. 20, 2014

(51) Int. Cl.

| | |
|---|---|
| ***H01R 13/648*** | (2006.01) |
| ***H01R 13/52*** | (2006.01) |
| ***H01R 13/6581*** | (2011.01) |
| ***H01R 24/60*** | (2011.01) |

(52) U.S. Cl.
CPC ..... *H01R 13/5202* (2013.01); *H01R 13/6581* (2013.01); *H01R 24/60* (2013.01)

(58) Field of Classification Search
CPC ..... H01R 23/7073; H01R 23/6873
USPC ..... 439/660, 607.35, 607.4, 537
See application file for complete search history.

(56) References Cited

U.S. PATENT DOCUMENTS

| | | | | |
|---|---|---|---|---|
| 7,108,520 | B1 * | 9/2006 | Delaney et al. | 439/79 |
| 7,241,153 | B2 * | 7/2007 | He et al. | 439/148 |
| 7,503,780 | B1 * | 3/2009 | Huang | 439/135 |
| 7,558,069 | B2 * | 7/2009 | Chung | 361/737 |
| 7,632,156 | B1 * | 12/2009 | Chiang | 439/682 |
| 8,047,859 | B2 * | 11/2011 | Chang | 439/135 |
| 8,662,928 | B1 * | 3/2014 | Xie et al. | 439/607.58 |
| 2002/0022407 | A1 * | 2/2002 | Niitsu et al. | 439/676 |
| 2005/0159040 | A1 * | 7/2005 | Brunker et al. | 439/497 |
| 2009/0148107 | A1 * | 6/2009 | Hashiguchi | 385/92 |
| 2011/0034079 | A1 * | 2/2011 | Nagata et al. | 439/607.01 |

* cited by examiner

*Primary Examiner* — Abdullah Riyami
*Assistant Examiner* — Thang Nguyen
(74) *Attorney, Agent, or Firm* — Cheng-Ju Chiang

(57) ABSTRACT

An electrical connector includes an insulating housing, a plurality of electrical terminals integrated in the insulating housing, a shielding shell, an external housing and a water-proof assembly. The shielding shell is worn around the insulating housing and has a bottom plate opened with a pair of through slots. The external housing is molded outside the insulating housing and the shielding shell, and has a bottom wall defined with a pair of through holes which are corresponding to the through slots. The water-proof assembly is embedded in the bottom of the external housing and has a pair of elastic arms elastically project upward through the through holes of the external housing and the through slots of the shielding shell.

8 Claims, 6 Drawing Sheets

ELECTRICAL CONNECTOR

BACKGROUND OF THE INVENTION

1. Field of the Invention

The present invention relates to a connector, and more particularly to an electrical connector.

2. the Related Art

A traditional electrical connector includes an insulating body, a plurality of electrical terminals and a shielding shell. The electrical terminals are integrated in the insulating body respectively. The shielding shell has a top plate, a bottom plate, a rear plate and two side plates which corporately define a receiving chamber for receiving the insulating body and the electrical terminals therein. The bottom plate of the shielding shell is die-cut upward to form a pair of elastic pieces for fastening a butting connector.

However, the traditional electrical connector does not have waterproof function. As a result, when the water or the moisture flows into the electrical connector, the traditional electrical connector is apt to result in a communication failure with the butting connector.

SUMMARY OF THE INVENTION

Accordingly, an object of the present invention is to provide an electrical connector. The electrical connector includes an insulating housing, a plurality of electrical terminals, a shielding shell, an external housing and a water-proof assembly. The insulating housing has a base portion. A front of the base portion extends frontward to form a tongue board having a smaller dimension than the base portion. A top face of the tongue board is concaved downward and extended rearward to form a plurality of upper terminal grooves. A bottom face of the tongue board is concaved upward and extended rearward to form a plurality of lower terminal grooves. The upper terminal grooves and the lower terminal grooves further penetrate downward through a bottom face of the base portion of the insulating housing. The electrical terminals include a plurality of upper terminals and a plurality of lower terminals. The upper terminals and the lower terminals are respectively held in the upper terminal grooves and the lower terminal grooves of the insulating housing. The shielding shell encloses the insulating housing. The shielding shell has a top plate, a bottom plate and two side plates which corporately define a receiving chamber for receiving the insulating housing and the electrical terminals therein. A front of the bottom plate of the shielding shell is opened with a pair of through slots. The through slots penetrate through top and bottom faces of the bottom plate. The external housing is molded outside the insulating housing and the shielding shell. The external housing has a top wall, a bottom wall, a rear wall and two side walls which corporately define a receiving space for receiving the insulating housing and the shielding shell therein. A front of a bottom face of the bottom wall of the external housing is concaved upward to form a holding cavity. A top face of the holding cavity is further concaved upward to form a pair of through holes corresponding to the through slots of the shielding shell. The water-proof assembly is held in the bottom wall of the external housing. The water-proof assembly includes a buckling element, a holding element and a locking element. The buckling element is molded around a bottom part of the holding element. The locking element is molded in the holding element and has a pair of elastic arms projecting above the holding element. The water-proof assembly is held in the holding cavity of the external housing and the elastic arms of the locking element elastically project into the receiving chamber through the through holes of the external housing and the through slots of the shielding shell.

As described above, the external housing is molded outside the insulating housing and the shielding shell, and the water-proof assembly is molded in the bottom of the external housing, so that greatly prevent the water from flowing into the inside of the electrical connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
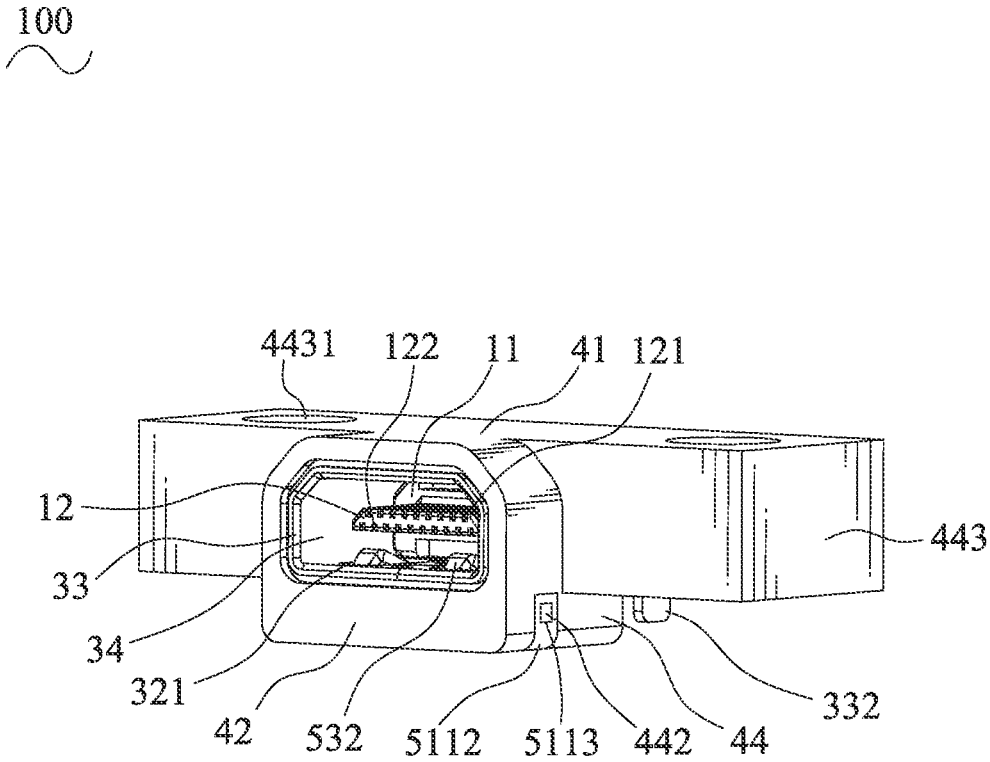
FIG. 1 is an assembled, perspective view of an electrical connector in accordance with an embodiment of the present invention.
Figure 2:
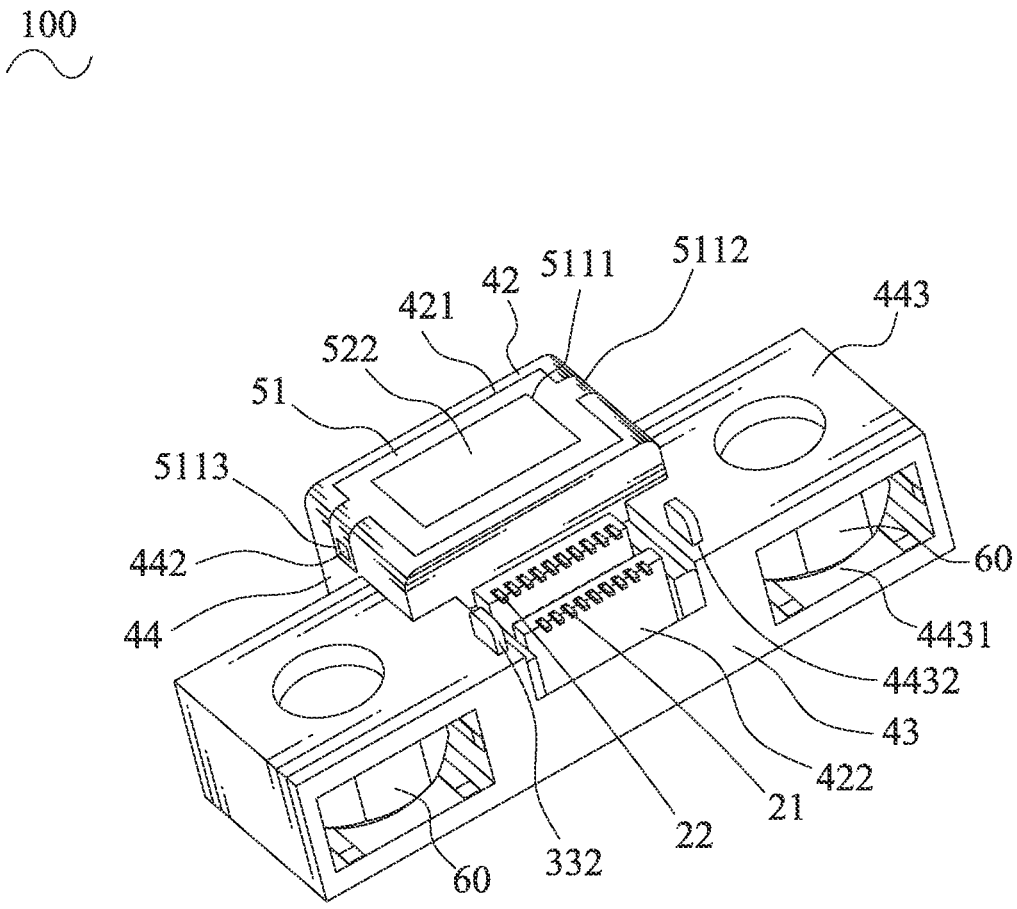
FIG. 2 is another assembled, perspective view of the electrical connector shown in FIG. 1.
Figure 3:
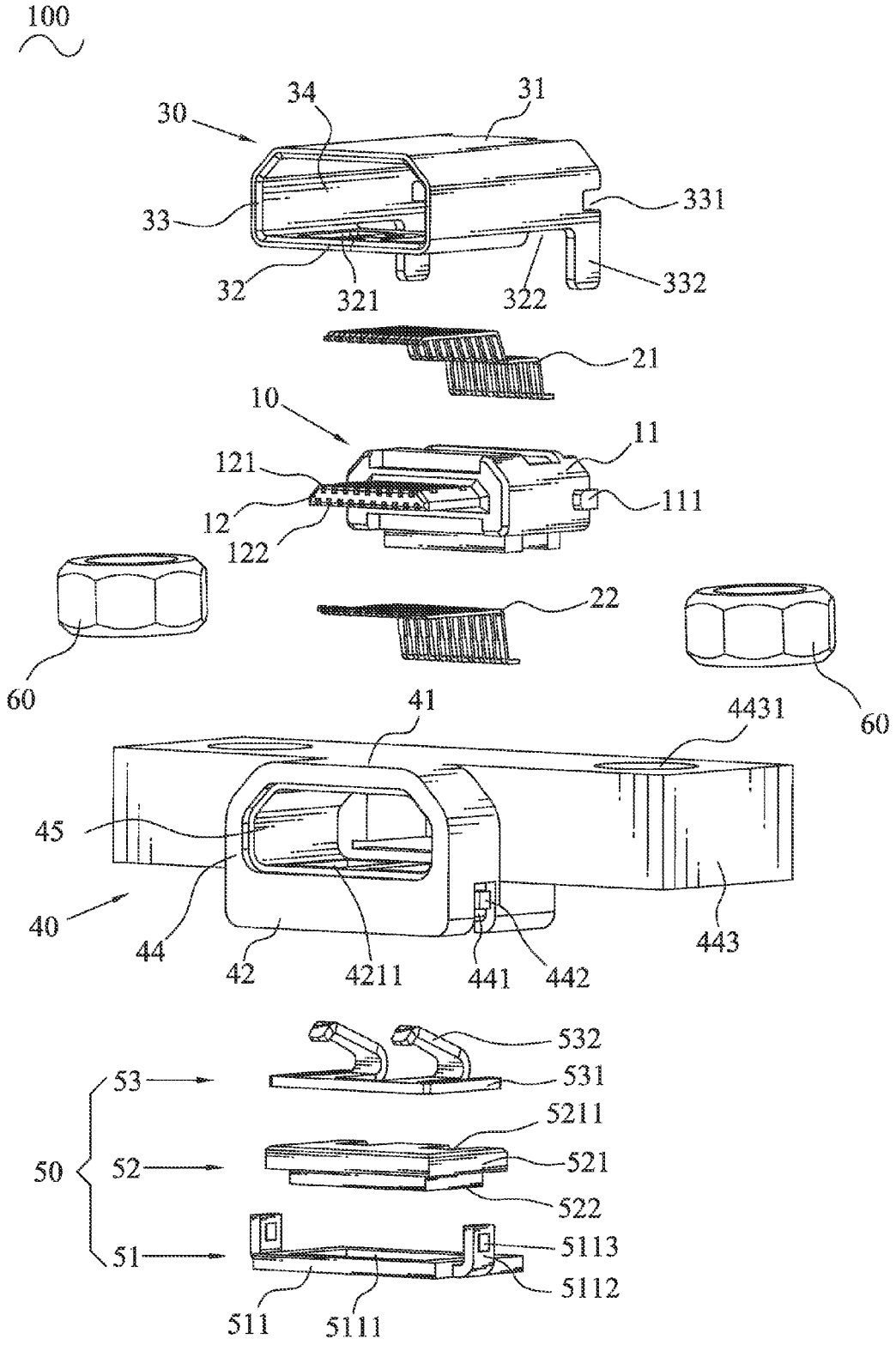
FIG. 3 is an exploded, perspective view of the electrical connector shown in FIG. 1.

Referring to the drawings in greater detail, and first to FIG. 3, an embodiment of the present invention is embodied in an electrical connector 100. The electrical connector 100 includes an insulating housing 10, a plurality of electrical terminals, a shielding shell 30, an external housing 40, a water-proof assembly 50 and a pair of nuts 60.

The insulating housing 10 has a base portion 11. A front of the base portion 11 extends frontward to form a tongue board 12 having a smaller dimension than the base portion 11. A top face of the tongue board 12 is concaved downward and extended rearward to form a plurality of upper terminal grooves 121. A bottom face of the tongue board 12 is concaved upward and extended rearward to form a plurality of lower terminal grooves 122. The upper terminal grooves 121 and the lower terminal grooves 122 further penetrate downward through a bottom face of the base portion 11 of the insulating housing 10. Two opposite sides of the base portion 11 of the insulating housing 10 protrude outward respectively to form a pair of buckling lumps 111 at the rear thereof.

Referring to FIG. 3, the electrical terminals include a plurality of upper terminals 21 and a plurality of lower terminals 22. The upper terminals 21 and the lower terminals 22 are integrated in the insulating housing 10 and are respectively held in the upper terminal grooves 121 and the lower terminal grooves 122 of the insulating housing 10. The tails of the upper terminals 21 and the lower terminals 22 project beyond the bottom face of the base portion 11 of the insulating housing 10 and further are soldered on a PCB (not shown) to realize electrical connection with the PCB.

Figure 4:
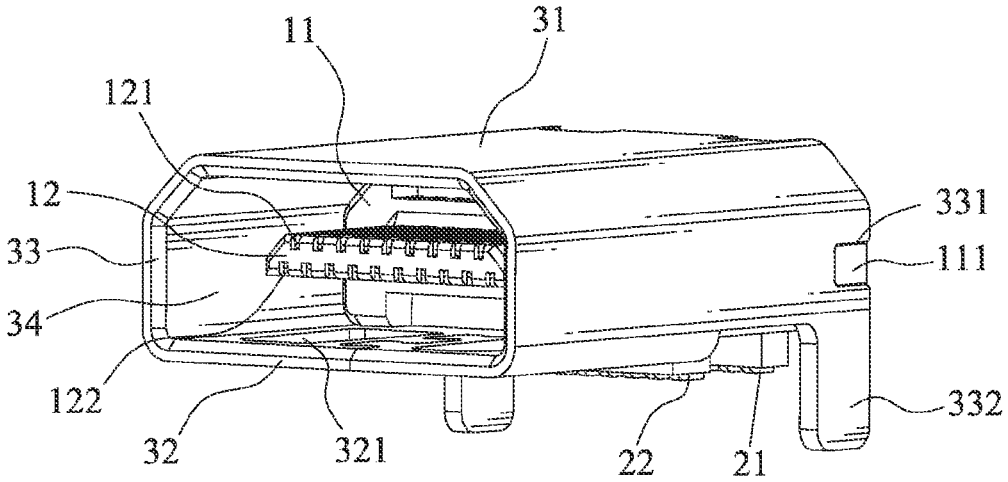
FIG. 4 is an assembled, perspective view of a part of the electrical connector shown in FIG. 1.
Figure 5:
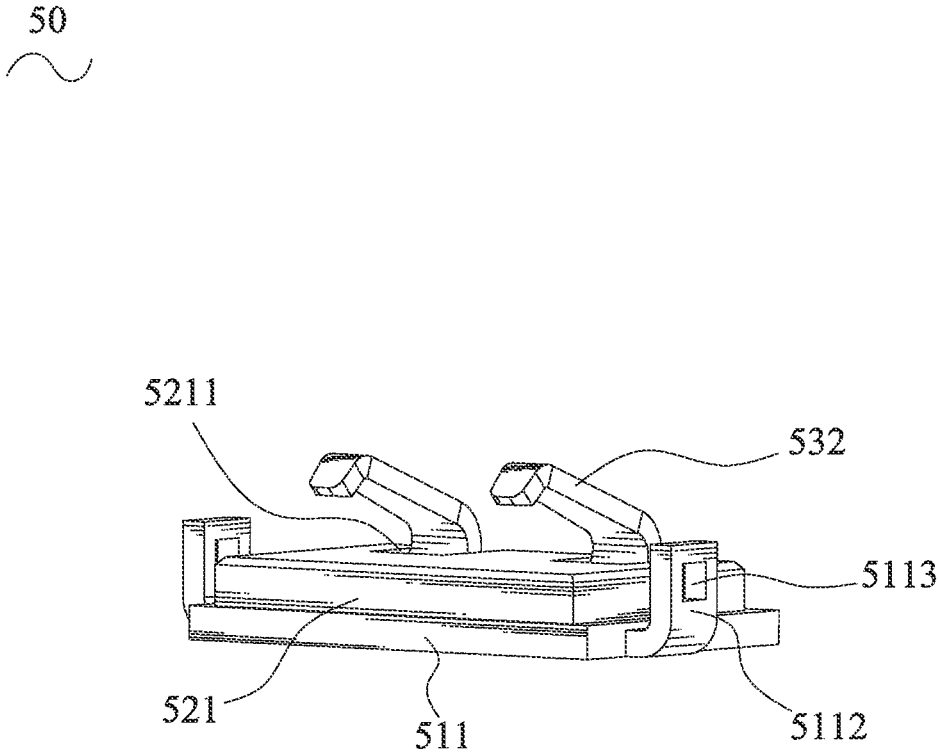
FIG. 5 is an assembled, perspective view of a water-proof assembly of the electrical connector shown in FIG. 1.
Figure 6:
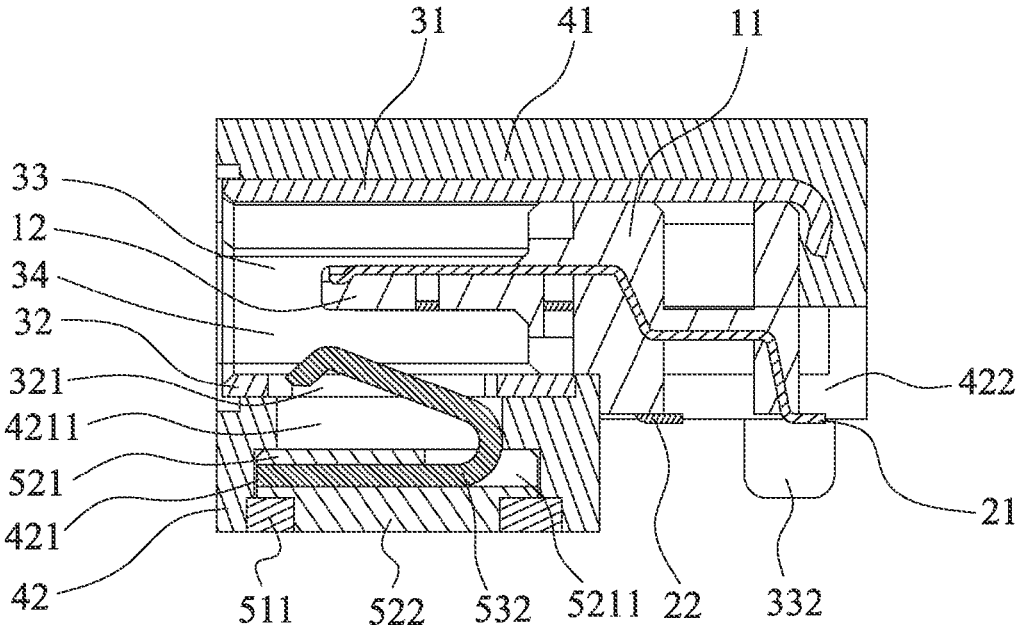
FIG. 6 is a cross-sectional view of the electrical connector shown in FIG. 1.

Referring to FIG. 3 and FIG. 4, the shielding shell 30 encloses the insulating housing 10. The shielding shell 30 has a top plate 31, a bottom plate 32 and two side plates 33 which corporately define a receiving chamber 34 for receiving the insulating housing 10 and the electrical terminals therein. A front of the bottom plate 32 of the shielding shell 30 is opened with a pair of through slots 321 penetrating through top and bottom faces of the bottom plate 32 of the shielding shell 30.

A rear edge of the bottom plate 32 of the shielding shell 30 is concaved frontward to form a gap 322. A bottom part of the base portion 11 of the insulating housing 10 is buckled in and further projects out of the gap 322 of the shielding shell 30. Rear edges of the side plates 33 of the shielding shell 30 are concaved frontward to form a pair of buckling slots 331. The buckling lumps 111 of the insulating housing 10 are buckled in the buckling slots 331 of the shielding shell 30. A bottom of a rear of each side plate 33 of the shielding shell 30 protrudes downward to form a soldering portion 332, and the soldering portions 332 are soldered in the PCB to fasten the shielding shell 30.

Referring to FIG. 1, FIG. 2, FIG. 3 and FIG. 6, the external housing 40 is molded outside the insulating housing 10 and the shielding shell 30. The external housing 40 has a top wall 41, a bottom wall 42, a rear wall 43 and two side walls 44 which corporately define a receiving space 45 for receiving the insulating housing 10 and the shielding shell 30 therein. A front of a bottom face of the bottom wall 42 of the external housing 40 is concaved upward to form a holding cavity 421. A top face of the holding cavity 421 is further concaved upward through the bottom wall 42 to form a pair of through holes 4211 corresponding to the through slots 321 of the shielding shell 30. A rear of the bottom wall 42 of the external housing 40 is opened with an opening 422 corresponding to the gap 322 of the shielding shell 30. The bottom part of the base portion 11 of the insulating housing 10 projecting out of the shielding shell 30 is buckled in the opening 422 of the external housing 40. Fronts of two opposite outsides of the bottom wall 42 are concaved inward to form a pair of buckling grooves 441. Inner sidewalls of the buckling grooves 441 protrude outward to form a pair of buckling blocks 442. Rears of the side walls 44 of the external housing 40 oppositely protrude outward to form a pair of fixing wings 443. Back faces of the fixing wings 443 are concaved frontward to form a pair of fixing slots 4431 of which each middle further vertically penetrates through the corresponding fixing wing 443. The nuts 60 are fixed in the fixing slots 4431 and fastened by screws (not shown) to fixed the electrical connector 100. Bottom faces of the fixing wings 443 are opened with a pair of soldering holes 4432 corresponding to the soldering portions 332 of the shielding shell 30. The soldering portions 332 of the shielding shell 30 pass through the soldering holes 4432 to be soldered in the PCB.

Referring to FIG. 1, FIG. 2, FIG. 3, FIG. 5 and FIG. 6, the water-proof assembly 50 is held in the bottom wall 42 of the external housing 40. The water-proof assembly 50 includes a buckling element 51, a holding element 52 and a locking element 53. The locking element 53 has a lying-U shaped fastening portion 531. An inside of the bend of the fastening portion 531 protrudes rearward, then is arcuately bent upward and further extends slantwise forward to form a pair of elastic arms 532 of which the distal ends are bent downward. The holding element 52 has a holding substrate 521. A substantially center of a bottom face of the holding substrate 521 protrudes downward to form a blocking portion 522. The fastening portion 531 of the locking element 53 is molded in the holding substrate 521 of the holding element 52 and the elastic arms 532 project above the holding substrate 521 of the holding element 52. In detail, a rear of a top face of the holding substrate 521 of the holding element 52 is concaved downward to form a pair of passageways 5211. The elastic arms 532 of the locking element 53 are partially received in the passageways 5211 of the holding element 52 and the free ends of the elastic arms 532 project above the holding substrate 521 of the holding element 52. The buckling element 51 is molded around a bottom part of the holding element 52.

In detail, the buckling element 51 has a buckling board 511. A center of the buckling board 511 is opened with a buckling window 5111 corresponding to the blocking portion 522 of the holding element 52. The blocking portion 522 of the holding element 52 is buckled in the buckling window 5111 of the buckling element 51. The buckling board 511 of the buckling element 51 and the holding substrate 521 of the holding element 52 of the water-proof assembly 50 are held in the holding cavity 421 of the external housing 40. The elastic arms 532 of the locking element 53 elastically project into the receiving chamber 34 through the through holes 4211 of the external housing 40 and the through slots 321 of the shielding shell 30. Two lateral edges of the buckling board 511 of the buckling element 51 of the water-proof assembly 50 protrude upward to form a pair of buckling strips 5112. Each of the buckling strips 5112 is opened with a fastening hole 5113 corresponding to the buckling block 442 of the external housing 40. The buckling strips 5112 of the buckling element 51 are buckled in the buckling grooves 441 of the external housing 40 and the buckling blocks 442 of the external housing 40 are buckled in the fastening holes 5113 of the buckling element 51.

As described above, the external housing 40 is molded outside the insulating housing 10 and the shielding shell 30, and the water-proof assembly 50 is molded in the bottom of the external housing 40, so that greatly prevent the water from flowing into the inside of the electrical connector 100.

What is claimed is:

1. An electrical connector, comprising:

an insulating housing having a base portion, a front of the base portion extending frontward to form a tongue board having a smaller dimension than the base portion, a top face of the tongue board being concaved downward and extended rearward to form a plurality of upper terminal grooves, a bottom face of the tongue board being concaved upward and extended rearward to form a plurality of lower terminal grooves, the upper terminal grooves and the lower terminal grooves further penetrating downward through a bottom face of the base portion of the insulating housing;

a plurality of electrical terminals including a plurality of upper terminals and a plurality of lower terminals, the upper terminals and the lower terminals being respectively held in the upper terminal grooves and the lower terminal grooves of the insulating housing;

a shielding shell enclosing the insulating housing, the shielding shell having a top plate, a bottom plate and two side plates which corporately define a receiving chamber for receiving the insulating housing and the electrical terminals therein, a front of the bottom plate of the shielding shell being opened with a pair of through slots, the through slots penetrating through top and bottom faces of the bottom plate;

an external housing molded outside the insulating housing and the shielding shell, the external housing having a top wall, a bottom wall, a rear wall and two side walls which corporately define a receiving space for receiving the insulating housing and the shielding shell therein, a front of a bottom face of the bottom wall of the external housing being concaved upward to form a holding cavity, a top face of the holding cavity being further concaved upward to form a pair of through holes corresponding to the through slots of the shielding shell; and a water-proof assembly held in the bottom wall of the external housing, the water-proof assembly including a buckling element, a holding element and a locking element, the buckling element being molded around a bottom part of the holding element, the locking element being molded in the holding element and having a pair of elastic arms projecting above the holding element, the water-proof assembly being held in the holding cavity of the external housing and the elastic arms of the locking element elastically projecting into the receiving chamber through the through holes of the external housing and the through slots of the shielding shell.

2. The electrical connector as claimed in claim 1, wherein the locking element of the water-proof assembly has a lying-U shaped fastening portion, an inside of the bend of the fastening portion protrudes rearward, then is arcuately bent upward and further extends slantwise forward to form the elastic arms of which the distal ends are bent downward, the fastening portion of the locking element is molded in the holding element.

3. The electrical connector as claimed in claim 2, wherein the holding element of the water-proof assembly has a holding substrate, a substantial center of a bottom face of the holding substrate protrudes downward to form a blocking portion, the buckling element of the water-proof assembly has a buckling board, a center of the buckling board is opened with a buckling window corresponding to the blocking portion of the holding element, the fastening portion of the locking element is molded in the holding substrate of the holding element, the blocking portion of the holding element is buckled in the buckling window of the buckling element.

4. The electrical connector as claimed in claim 3, wherein fronts of two opposite outsides of the bottom wall of the external housing are concaved inward to form a pair of buckling grooves, inner sidewalls of the buckling grooves protrude outward to form a pair of buckling blocks, two lateral edges of the buckling board of the buckling element of the water-proof assembly protrude upward to form a pair of buckling strips, each of the buckling strips is opened with a fastening hole corresponding to the buckling block of the external housing, the buckling strips of the buckling element are buckled in the buckling grooves of the external housing and the buckling blocks of the external housing are buckled in the fastening holes of the buckling element.

5. The electrical connector as claimed in claim 3, wherein a rear of a top face of the holding substrate of the holding element is concaved downward to form a pair of passageways, the elastic arms of the locking element are partially received in the passageways of the holding element and the free ends of the elastic arms project above the holding substrate of the holding element.

6. The electrical connector as claimed in claim 1, wherein a rear edge of the bottom plate of the shielding shell is concaved frontward to form a gap, a rear of the bottom wall of the external housing is opened with an opening corresponding to the gap of the shielding shell, a bottom part of the base portion of the insulating housing is buckled in the gap of the shielding shell and the opening of the external housing.

7. The electrical connector as claimed in claim 1, wherein two opposite sides of the base portion of the insulating housing protrude outward to form a pair of buckling lumps at the rear thereof, rear edges of the side plates of the shielding shell are concaved frontward to form a pair of buckling slots, the buckling lumps of the insulating housing are buckled in the buckling slots of the shielding shell.

8. The electrical connector as claimed in claim 1, wherein rears of the side walls of the external housing oppositely protrude outward to form a pair of fixing wings, back faces of the fixing wings are concaved frontward to form a pair of fixing slots of which each middle further vertically penetrates through the corresponding fixing wing, the electrical connector further includes a pair of nuts, the nuts are fixed in the fixing slots of the external housing.

* * * * *